United States Patent [19]

Ikemoto et al.

[11] Patent Number: 4,478,523

[45] Date of Patent: Oct. 23, 1984

[54] SPEECH SYNTHESIZER TIMEPIECE WITH MINIMAL NUMBER OF KEYS FOR TIME ANNOUNCEMENTS

[75] Inventors: Yutaka Ikemoto, Nara; Hiroshi Tsuda, Uji, both of Japan

[73] Assignee: Sharp Kabushiki Kaisha, Osaka, Japan

[21] Appl. No.: 360,674

[22] Filed: Mar. 22, 1982

[30] Foreign Application Priority Data

| | | | |
|---|---|---|---|
| Mar. 24, 1982 | [JP] | Japan | 56-43661 |
| Mar. 26, 1982 | [JP] | Japan | 56-44946 |
| Mar. 26, 1982 | [JP] | Japan | 56-44947 |
| Mar. 26, 1982 | [JP] | Japan | 56-44949 |

[51] Int. Cl.[3] ..... G04B 21/08; G04C 19/00

[52] U.S. Cl. ..... 368/63; 368/82

[58] Field of Search ..... 368/63, 69–74, 368/82, 107, 111, 185, 187, 239, 28–30

[56] References Cited

U.S. PATENT DOCUMENTS

| | | | |
|---|---|---|---|
| 4,023,345 | 5/1977 | Imamura | 368/111 |
| 4,092,822 | 6/1978 | Droz et al. | 368/187 |
| 4,279,030 | 7/1981 | Masuzawa et al. | 368/63 |
| 4,287,584 | 9/1981 | Tanimoto et al. | 368/63 |

*Primary Examiner*—Vit W. Miska

*Attorney, Agent, or Firm*—Birch, Stewart, Kolasch and Birch

[57] ABSTRACT

A speech synthesizer timepiece which is capable of providing a plurality of different kinds of time-related information such as updated time, timer information (remaining time), alarm information and so forth using speech synthesizing technology with the aid of a single voice key. The timepiece has a voice instruction key for activating the speech synthesizer and a detection circuit for detecting if the key is actuated continuously. The speech generation is enabled to provide a first item of information (for example, timer information) when the key is actuated temporarily and providing another item of information (for example, updated time) when the instruction key is continuously actuated.

3 Claims, 3 Drawing Figures

SPEECH SYNTHESIZER TIMEPIECE WITH MINIMAL NUMBER OF KEYS FOR TIME ANNOUNCEMENTS

BACKGROUND OF THE INVENTION

This invention relates to a speech synthesizer timepiece capable of providing a plurality of various kinds of audio messages using a single vioce key.

For a speech synthesizer timepiece having a timer function, the necessity often arises that it provide in an audible form (e.g., synthesized human voices) a plurality of time-related information including remaining time of the timer and updated time of day. With the great demand for a minimum size of the timepiece, the number of keys should be reduced to a minimum.

OBJECT AND SUMMARY OF THE INVENTION

Accordingly, it is an object of the present invention to provide a timepiece which is capable of providing a plurality of various kinds of time-related information through the use of a single key.

For a timepiece having a timer function, the remaining time of the timer is audibly announced upon actuation of a single voice key and the updated time day is announced upon the lapse of a predetermined period of time after continuous actuation of the same voice key.

If the timepiece has a calendar function, then the timepiece is designed to audibly announce the updated time of day upon actuation of the voice key and announce several pieces of calendar information (month, date and day of the week, etc) upon continuation of the key actuation over a predetermined period of time. In the case of the timepiece having the timer as described previously, the updated time of day may be announced upon depression of the key and the remaining time of the timer may be displayed in response to a voice start instruction. It is further preferable that the remaining time be audibly announced and the updated time of day be visually displayed upon depression of the voice key. Further, when the key is depressed continuously over a predetermined period of time, the updated time of day is announced and the remaining time of the timer is visually displayed.

BRIEF DESCRIPTION OF THE DRAWING

For a more complete understanding of the present invention and for further objects and advantages thereof, reference is now made to the following description taken in conjunction with the accompanying drawing showing an embodiment of the present invention, in which.

DETAILED DESCRIPTION OF THE INVENTION

Figure 1:
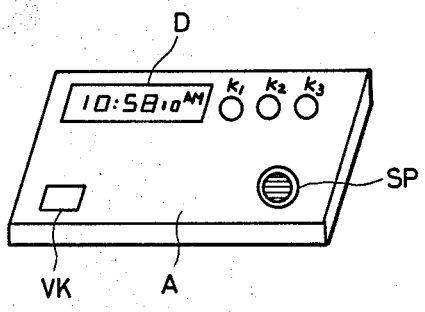
FIG. 1 is a perspective view of a speech synthesizer timepiece according to an embodiment of the present invention.

The following description will be directed to a speech synthesizer timepiece having a timer function constructed according to an embodiment of the present invention. FIG. 1 is a perspective view of the timepiece wherein there are provided within a main body A, a voice key VK, selection keys $K_1$, $K_2$ and $K_3$ for mode selection, hours adjustment, and minutes adjustment, a visual display D, a loudspeaker SP, and so forth.

Figure 2:
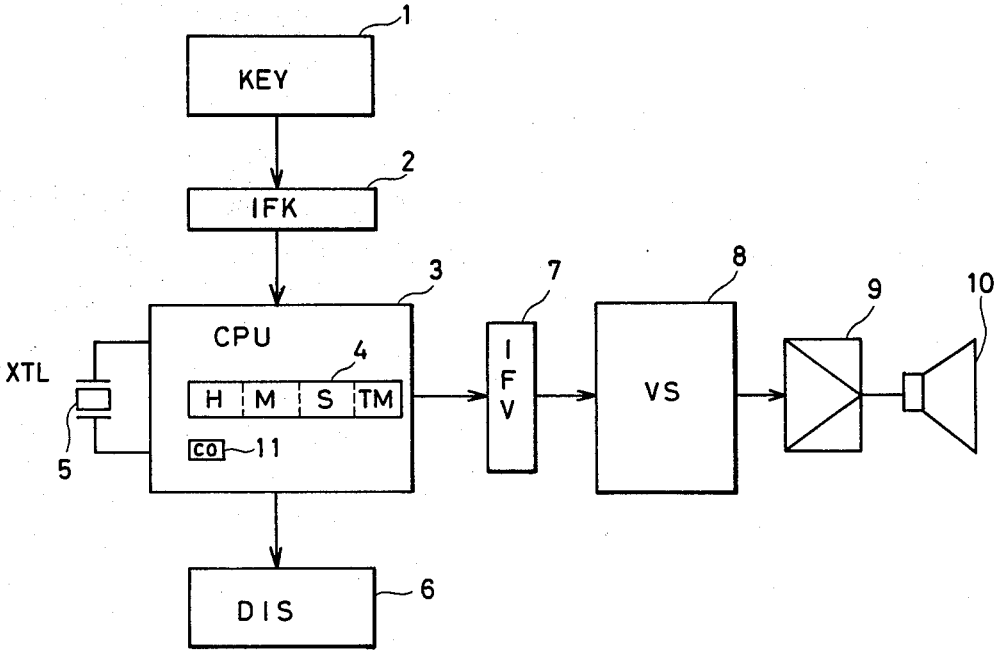
FIG. 2 is a systematic block diagram of the timepiece.

In FIG. 2 illustrating a systematic block diagram of the timepiece, there are provided keys 1, a key interface 2 and a timekeeping circuit 3. The timekeeping circuit 3 includes a central processing unit (CPU), a random access memory (RAM) 4 for storing hours (H) information, minutes (M) information, seconds (S) information and remaining time (TM) information and a counter (CO) 11 contained in part of the RAM for storing a predetermined period of time. The remaining time of the timer is represented by a preset time loaded in TM via the keys while being counted down automatically every second. In other words, the remaining time shows minutes or seconds to go. The counter CO decides if the same key is actuated continuously over the predetermined period of time and stores a constant T as its initial value. The constant K is fixedly stored in a ROM as discussed hereinafter. A quartz oscillator 5 generates a standard frequency. There are further provided a visual display 6, an interface 7, a speech synthesizer 8, an amplifier 9 and a loudspeaker 10. An audible message is delivered from the loudspeaker.

Figure 3:
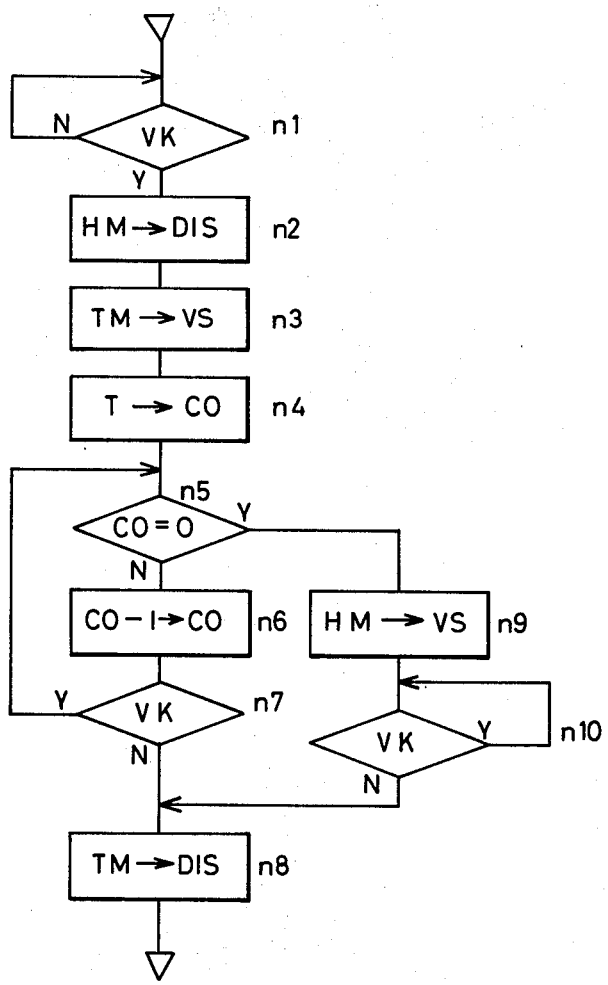
FIG. 3 is a flow chart for explaining the operation of the timepiece.

FIG. 3 is a flow chart for explaining the operation of various components. When the voice key VK in the keyboard 1 is depressed, key input information is sent to and encoded by the timekeeping circuit (CPU) 3 by way of the key interface 2. The count of the remaining time storing counter TM, that is, the keyed preset time minus countdowns taking place every second, is fed to the speech synthesizer (VS) 8 via the interface 7. The count of TM is synthesized and converted into a human voice and the resulting message "It is XXX minutes to go." is delivered through the amplifier 9 and the loudspeaker 10 (steps $n_1 \rightarrow n_2 \rightarrow n_3$).

The remaining time TM of the timer is visually displayed until the key VK is depressed. At the moment where the key is actuated, the remaining time in the timekeeping circuit 3 is replaced by the updated time of day including hours (H) and minutes (M). This mode of display continues until the key is actuated again. Upon further actuation of the key the display switches to the remaining time display mode again ($n_2$ and $n_8$).

In connection with the audible indication mode, on the other hand, the counter CO in the timekeeping circuit 3 decides if the key has been depressed continuously over the predetermined period of time ($n_5$) and, if so, the count of the counter CO is counted down every second. If CO=0 or if the key has been kept depressed over the predetermined period of time, the updated time of day is transferred from the hours (H) and minutes (M) sections of the timekeeping counter 4 to the speech synthesizer 8. For example, an audible message "It is 2:35 am." is delivered ($n_5 \rightarrow n_9$). It is already noted that the counter CO for detecting the time length of key depression contains as a constant, the initial value T fixedly stored in the memory ROM.

In this manner, the timepiece embodying the present invention announces more than one piece of time-related information using the single key. It shall be understood that more than one piece of time-related information is not necessarily announced whenever the key is actuated, but the second piece of time-related information is announced only when the key is actuated continuously over the predetermined period of time. In the case where the first and second pieces of time-related information are recalled at different frequencies, the first priority is assigned to that with the higher frequency and the second with the lower frequencies of announcement so that the first piece of information may be announced upon normal actuation of the key and both the first and second pieces of information be announced when the key is actuated continuously over the predetermined period of time.

In the case of the timepiece with the timer function, timer information or the remaining time of the timer is given the first priority with an adjective phrase "It is XXX minutes to go." during timer mode and the updated time of day such as "It is XXX (hours) XXX (minutes) AM (or PM)." is given the second priority. Therefore, the key must be depressed continuously over the predetermined period of time when it is desired to recall the updated time. It is of course obvious that the key may be kept depressed until delivery of the first piece of information is completed instead of being depressed continuously over the predetermined period of time. When this occurs, the updated time of day may be visually displayed while the key is being depressed.

For the timepiece having a calendar function, the updated time of day is given the higher priority and calendar information is given the lower priority. In other words, calendar messages such as month, date and the day of week are audibly announced when the key is being continuously actuated. The updated time of day is announced upon momentary or noncontinuous actuation of the key.

In the above-illustrated embodiment, the timepiece keeps on displaying the updated time of day while the key is kept in the depressed position, and displays the remaining time upon beginning of the updated time announcement which has been triggered by continued operation of the key.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A timepiece capable of providing at least two pieces of time-related information comprising:

speech generation means for providing an audible message;

speech instruction key means for activating said speech generation means;

display means for providing a visual display of at least one of said at least two pieces of information;

detection means for detecting actuation of said speech instruction key means; and means for enabling said speech generation means to provide an audible message indicative of one of said at least two pieces of information and said visual display to provide a visual display of the other of said speech at least two pieces of information according to the state of said instruction key means as detected by said detection means.

2. A timepiece with a timer function, comprising:

speech generation means for providing a first audible message indicative of timer information and a second audible message indicative of updated time of day;

speech instruction key means for activating said speech generation means;

visual display means for providing a first visual display indicative of timer information and a second visual display indicative of updated time information;

detection means for detecting if said speech instruction key means is kept actuated; and means responsive to the output of said detection means for enabling said speech generation means to provide said first audible message and said visual display to provide said second visual display when said speech instruction key means is actuated temporarily and enabling said speech generation means to provide said second audible message and said visual display to provide said first visual display when said speech instruction key means is actuated continuously.

3. A timepiece with a calendar function, comprising:

speech generation means for providing a first audible message indicative of calendar information and a second audible message indicative of updated time of day;

speech instruction key means for activating said speech generation means;

visual display means for providing a first visual display indicative of calendar information and a second visual display indicative of updated time information;

detection means for detecting if said speech instruction key means is kept actuated; and means responsive to the output of said detection means for enabling said speech generation means to provide said first audible message and said visual display to provide said second visual display when said speech instruction key means is actuated temporarily and enabling said speech generation means to provide said second audible message and said visual display to provide said first visual display when said speech instruction key means is actuated continuously.

* * * * *